US005640852A

United States Patent [19]

Atlas

[11] Patent Number: 5,640,852

[45] Date of Patent: Jun. 24, 1997

[54] COMPACT THERMAL ELECTRIC HEAT EXCHANGER

[76] Inventor: Boris Atlas, 6247 Royal Oak Ct., San Jose, Calif. 95123

[21] Appl. No.: 540,341

[22] Filed: Oct. 6, 1995

[51] Int. Cl.[6] ..... F25B 21/02

[52] U.S. Cl. ..... 62/3.7; 62/434; 165/110

[58] Field of Search ..... 62/3.2, 3.6, 3.7, 62/430, 434; 165/110, 111

[56] References Cited

U.S. PATENT DOCUMENTS

| | | | |
|---|---|---|---|
| 3,205,667 | 9/1965 | Frantti | 62/3.7 |
| 3,212,274 | 10/1965 | Eidus | 165/110 |
| 5,029,445 | 7/1991 | Higgins . | |
| 5,031,689 | 7/1991 | Jones et al. . | |
| 5,154,661 | 10/1992 | Higgins . | |
| 5,450,726 | 9/1995 | Higgins . | |

*Primary Examiner*—John M. Sollecito
*Attorney, Agent, or Firm*—Flehr, Hohbach, Test, Albritton & Herbert

[57] ABSTRACT

A compact heat exchanger for adjusting the temperature of a stream of liquid of unknown temperature. The heat exchanger includes a hollow core element provided with a passageway which extends therethrough. The core element has an outer surface extending therealong adjacent the passageway. A plurality of thermal electric elements are spaced apart along the outer surface of the core element for providing heating or cooling to the core element. Each thermal electric element has a heat transfer surface which generally conforms to the outer surface of the core element. An assembly is provided for clamping the plurality of thermal electric elements to the outer surface of the core element and includes a heat transfer member for each thermal electric element. The clamping assembly permits the heat transfer members to move independent of each other. The relative independent movement of the heat transfer members facilitates full engagement of the heat transfer surfaces of the thermal electric elements with the outer surface of the core element during expansion and contraction of the core element.

9 Claims, 7 Drawing Sheets

7
299
41
38
43
127
16
212
216
53
126
43a
132
241
206
213
207
168
36
166
139
10
52c
10
77a
253
242
244
144
51
203
96
77b
41a
141
211
77
202
201
93
96
216
308
306
231
217
208
276
277
204
5
5
309
271
281
272
298
291
273
297
287
296
122
288
61
62
54
322
123
286
52d
293
182
128
129
131
192
137
188
177
292
128a
124
191
136a
136
7

COMPACT THERMAL ELECTRIC HEAT EXCHANGER

This invention pertains generally to heat exchangers and, more specifically, to heat exchangers which operate without refrigerants.

Temperature control modules have been provided for use with numerous types of chambers for processing wafers in the semiconductor manufacture industry. Certain semiconductor manufacturing operations utilize a cluster tool having a plurality of process chambers or modules. These process modules include etchers and coolers. The chambers of a cluster tool typically operate at different internal temperatures from each other and in some instances an individual chamber has at least two internal portions or surfaces which operate at different temperatures from each other. A separate temperature control module is typically required for each surface or portion of a chamber operating at a distinct temperature.

Temperature control modules are currently available which include heat exchangers utilizing thermal electronics instead of freon or other undesirable chlorofluorocarbons. These heat exchangers and temperature control modules suffer from a number of disadvantages, however, including that their relatively large size necessitates that they be located away from the controlled environment of the chamber or cluster tool. There is, therefore, a need for a compact thermal electric heat exchanger which overcomes these disadvantages.

In general, it is an object of the present invention to provide a compact heat exchanger for use with a wafer processing chamber in a semiconductor manufacturing apparatus.

Another object of the invention is to provide a heat exchanger of the above character which has a small size so that it can be located in close proximity to the chamber.

Another object of the invention is to provide a heat exchanger of the above character which can be used with a process module of a cluster tool.

Another object of the invention is to provide a heat exchanger of the above character which can be located within the footprint of the process module.

Another object of the invention is to provide a heat exchanger of the above character which utilizes a plurality of thermal electric elements mounted in spaced apart positions on a core element.

Another object of the invention is to provide a heat exchanger of the above character in which the thermal electric elements are movable relative to each other so as to enhance full engagement between the thermal electric elements and the core element during expansion and contraction of the core element.

Additional objects and features of the invention will appear from the following description from which the preferred embodiments are set forth in detail in conjunction with the accompanying drawings.

In general, a compact heat exchanger is provided for adjusting the temperature of a stream of liquid of unknown temperature. The heat exchanger includes a hollow core element provided with a passageway which extends therethrough and has first and second end portions. The core element has an outer surface extending therealong adjacent the passageway. An inlet fitting is coupled to the core element in communication with the first end portion of the passageway for receiving the stream of liquid. An outlet fitting is coupled to the core element in communication with the second end portion of the passageway for discharging the stream of liquid. A plurality of thermal electric elements are spaced apart along the outer surface of the core element for providing heating or cooling to the core element. Each thermal electric element has a heat transfer surface which generally conforms to the outer surface of the core element. Means is provided for clamping the plurality of thermal electric elements to the outer surface of the core element and includes a heat transfer member for each thermal electric element. The means for clamping permits the heat transfer members to move independent of each other. The relative independent movement of the heat transfer members facilitates full engagement of the heat transfer surfaces of the thermal electric elements with the outer surface of the core element during expansion and contraction of the core element.

Figure 1:
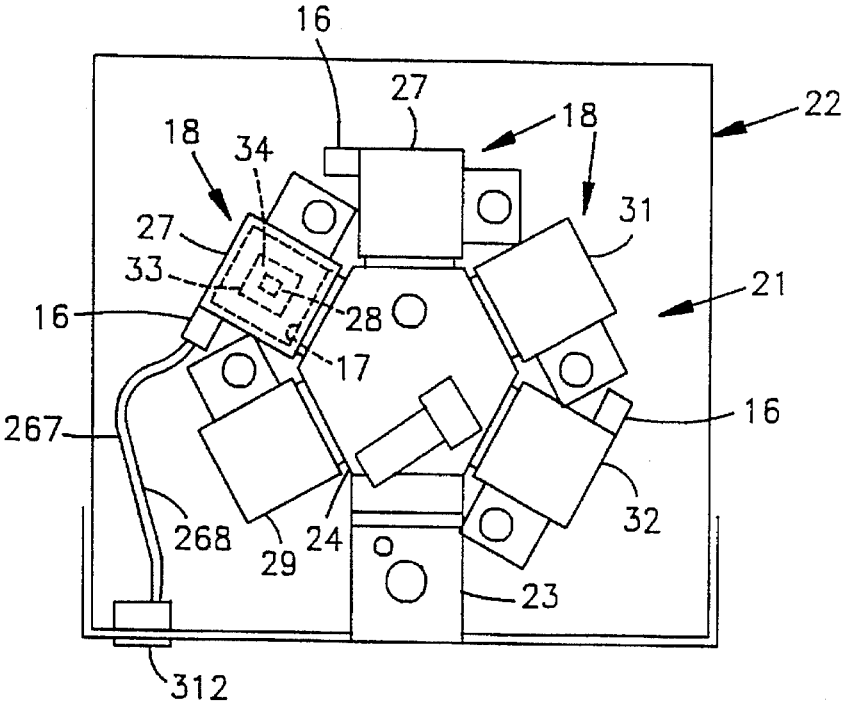
FIG. 1 is a plan view, somewhat schematic, of a cluster tool with three of the five process modules incorporating the compact replaceable temperature control module of the present invention.

More in particular, the compact replaceable temperature control apparatus or module 16 of the present invention is for use in controlling the temperature of a chamber 17 for wafer processing in semiconductor manufacturing. Chamber 17 could, for example, be used for vapor, chemical or other deposition on the wafer or for etching or cooling the wafer. A plurality of process modules 18 provided with respective internal chambers 16, one of which is illustrated, are shown in FIG. 1 as part of a conventional plasma cluster tool 21 situated within a class 1–10 clean room 22. In general, cluster tool 21 includes a cassette module 23 for loading wafers into the tool. A plurality and as illustrated five process modules 18 are centrally disposed about a transfer module 24 which moves wafers such as wafer 26 about the cassette and process modules. Process modules 18 could be in the form of a conventional plasma etching apparatus or etcher 27 such as an Applied Materials P5000 and, more specifically, include two etchers 27, a flatfinder 29, a photoresist stripper 31 and a cooling module or cooler 32.

In FIG. 1, a temperature control module 16 is shown mounted to each of the first and second etchers 27 and to cooler 32 so that the temperature of each of these process modules 18 can be independently controlled. The structure and operation of temperature control module 16 will hereinafter be described when necessary in connection with one of etchers 27 which, as illustrated, has an internal wall portion in the form of a pedestal 33 having an upper or chuck surface 34. Pedestal 33 is provided with an internal passageway (not shown) which travels therethrough in a serpentine pattern. Any suitable dielectric liquid, such as the Fluorinert dielectric liquid produced by the 3M Company, travels through the passageway within pedestal 33 for controlling the operating temperature of surface 34 during the process of etcher 27. The dielectric liquid is continuously discharged at an unknown temperature from the etcher during the operation of cluster tool 21.

Figure 2:
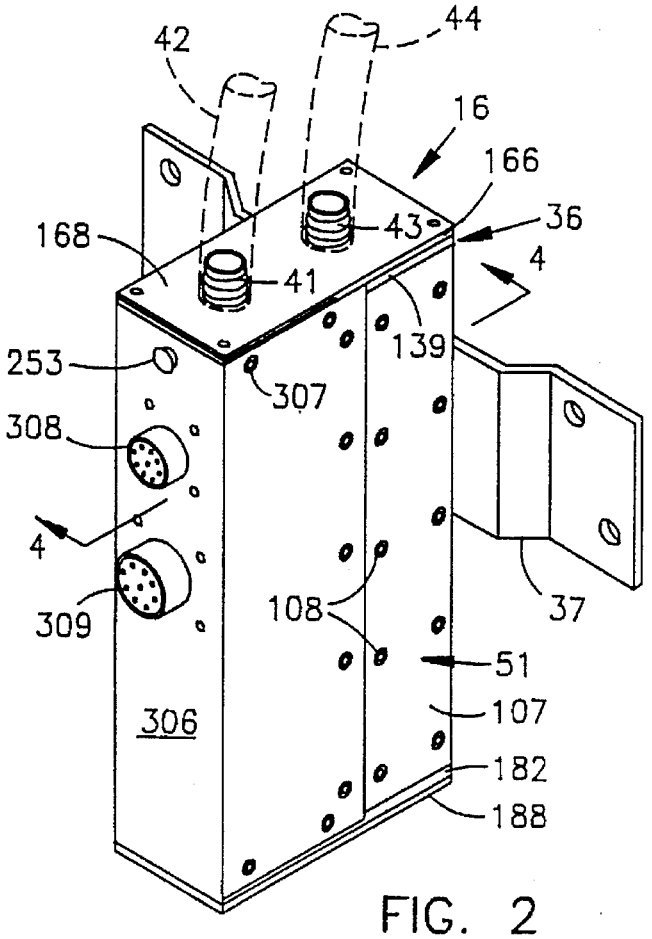
FIG. 2 is an isometric view of one of the compact replaceable temperature control modules illustrated in FIG. 1.
Figure 3:
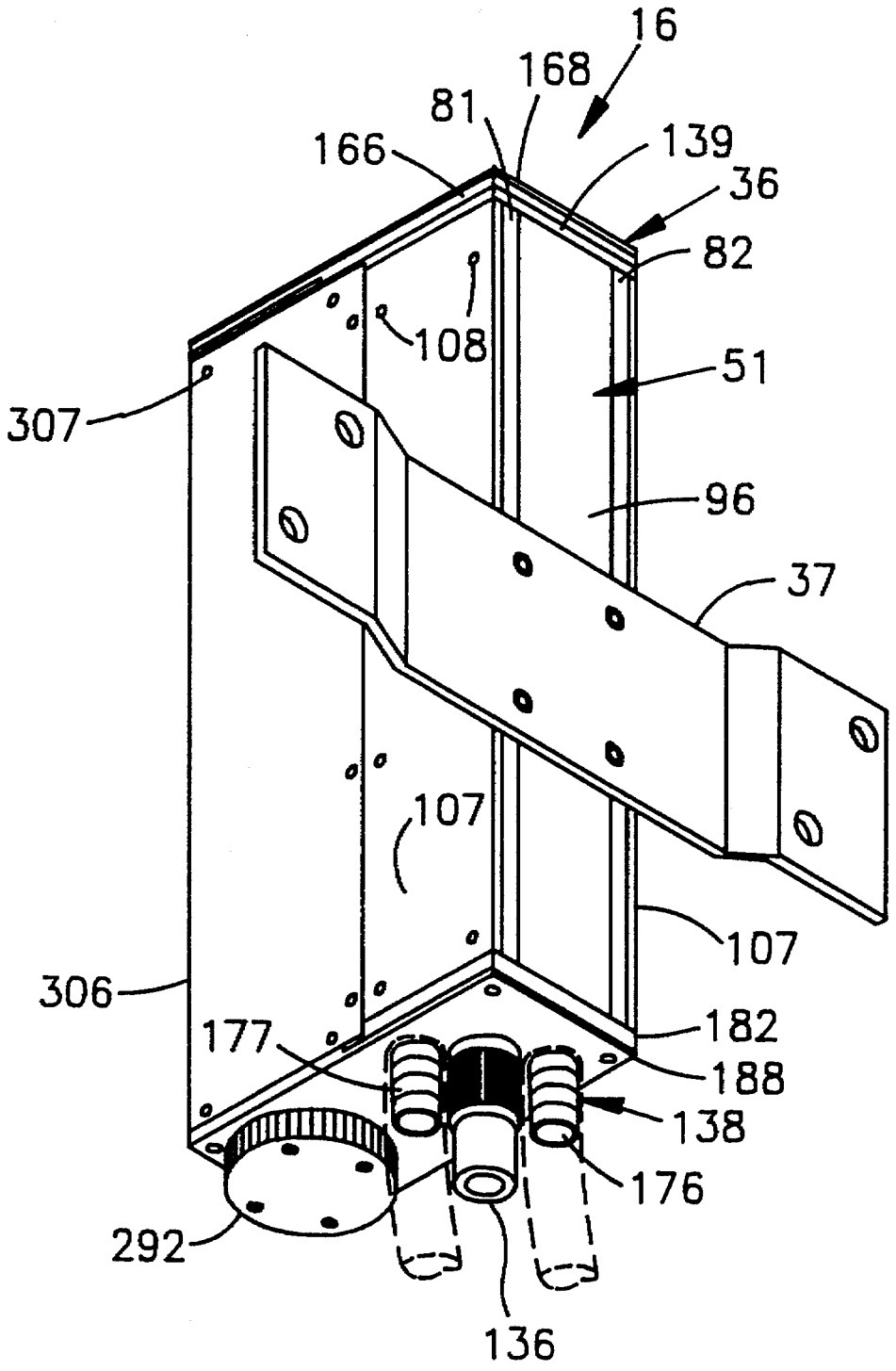
FIG. 3 is another isometric view of the compact replaceable temperature control module of FIG. 2.

Temperature control module 16 is more specifically shown in the isometric drawings of FIGS. 2 and 3 and, as illustrated therein, includes a support structure or housing 36 adapted to mount to the process module 18 by means of bracket 37 bolted or otherwise suitably secured to housing 36. The housing 36 is in the shape of a parallelepiped having a length of approximately 13 inches, a long transverse dimension of approximately 8 inches and a short transverse dimension of approximately 4 inches. First liquid carrying means in the form of first circulatory system 38 is carried by housing 36. The circulatory system includes an inlet barb fitting 41 which is adapted to couple to a flexible first or discharge tube 42 for receiving the dielectric liquid discharged from process module 18 and an outlet barb fitting 43 adapted to couple to a flexible second or inlet tube 44 for returning the dielectric liquid operated on by the temperature control module 16 to the process module 18.

Figure 5:
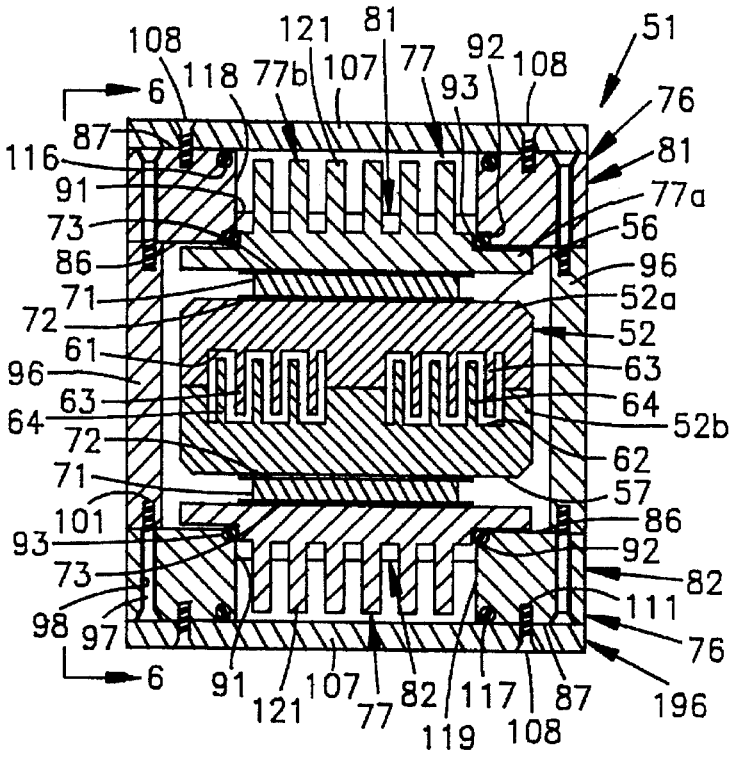
FIG. 5 is a cross-sectional view of the compact replaceable temperature control module of FIG. 2 taken along the line 5—5 of FIG. 4.
Figure 6:
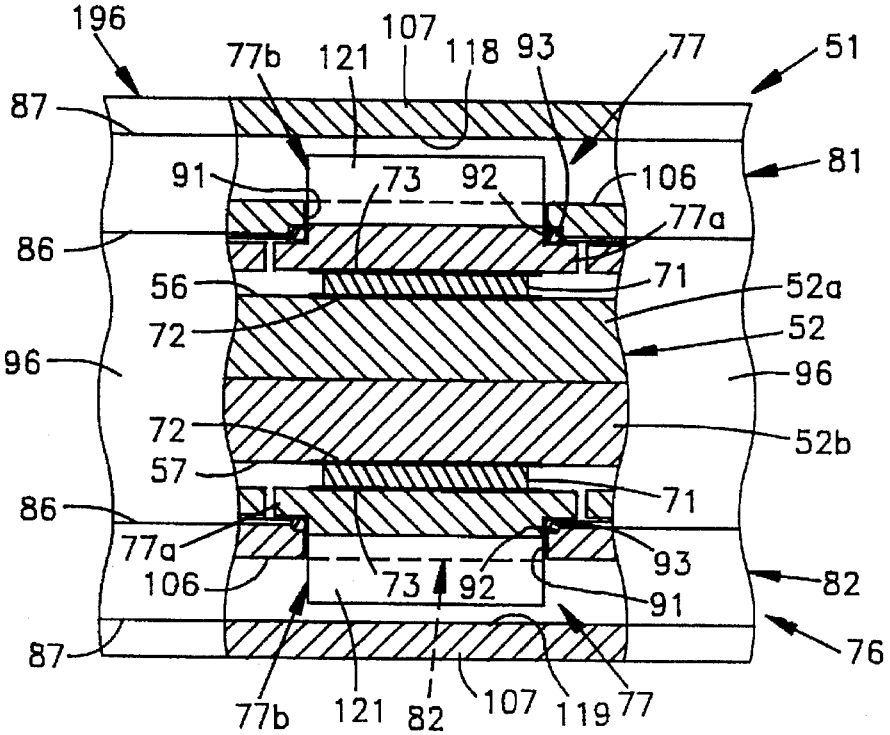
FIG. 6 is a side elevational view, partially cross-sectioned, of the compact replaceable temperature control module of FIG. 2 taken along the line 6—6 of FIG. 5.

A compact heat exchanger which includes thermal electric module 51 is included within temperature control module 16 for regulating the temperature of the stream of dielectric liquid supplied to module 16 from process module 18. Thermal electric module 51 includes an elongate hollow core element 52 made from any suitable material such as aluminum or oxygen free copper. As shown in FIGS. 5 and 6, core element 52 has a first half **52*a* and a second half 52*b* and a first or top end piece 52*c* and a second or bottom end piece 52*d*, all of which are secured together by any suitable means such as braizing. Core element 52 is generally in the shape of an elongate parallelepiped having a top end 53 and a bottom end 54. As such, the core element 52 is generally rectangular in cross section, as shown in FIG. 5, and is provided with spaced-apart parallel first and second outer surfaces 56 and 57 which extend longitudinally of the core element. Core element 52** has a length of approximately fifteen inches, a width of approximately four inches, and a thickness of approximately 1.5 inches.

At least one, and as shown in FIG. 5, spaced-apart first and second internal passageways or lumens 61 and 62 extend longitudinally through the center of tubular core element 52 between top and bottom ends 53 and 54. A plurality of interspaced first and second fins 63 and 64 extend inwardly into each of lumens 61 and 62 from the respective first and second halves **52*a* and 52*b* of core element 52. Fins 63 and 64** extend longitudinally through the length of the passageways.

Figure 4:
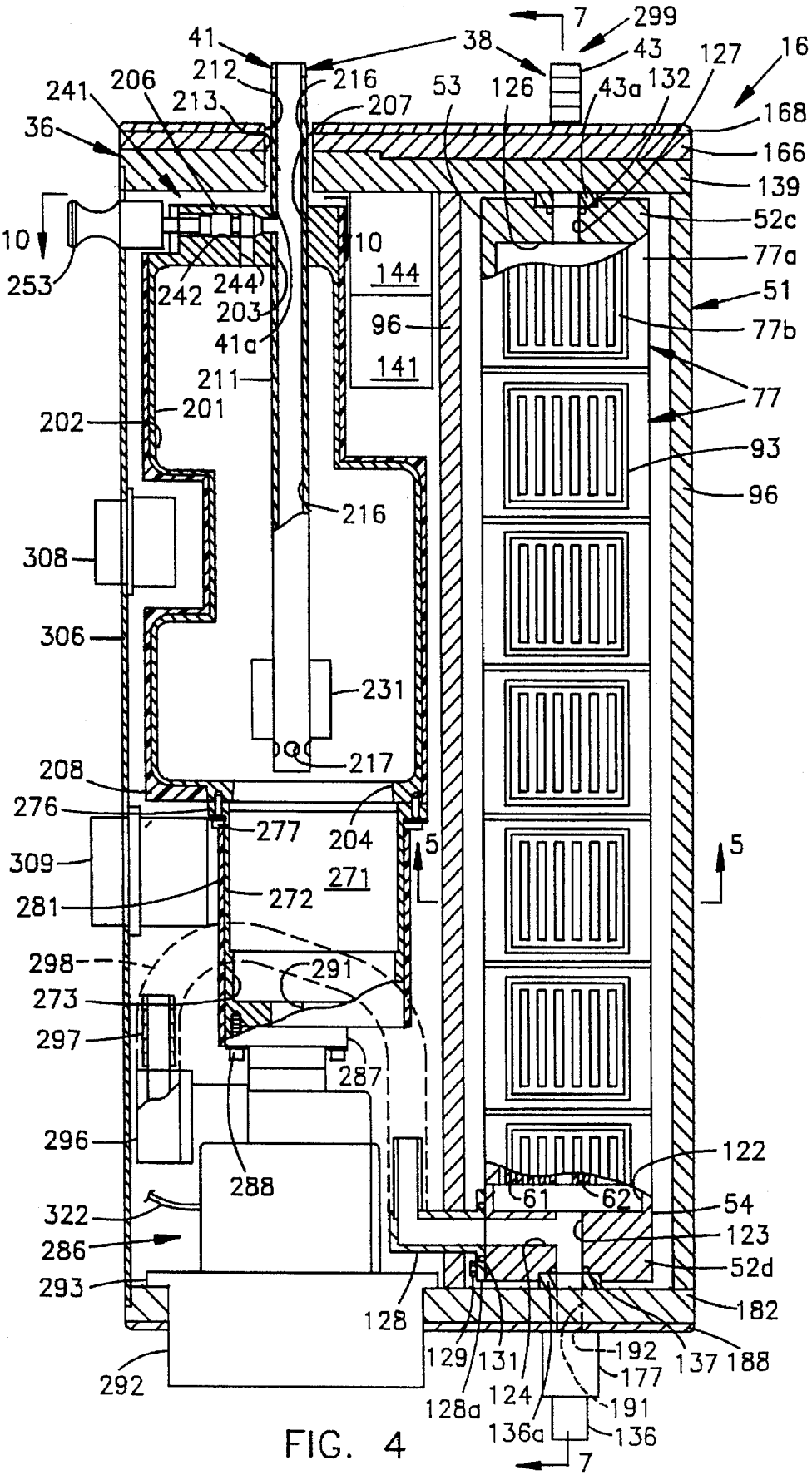
FIG. 4 is a cross-sectional view, partially cut away, of the compact replaceable temperature control module of FIG. 2 taken along the line 4—4 of FIG. 2.

A plurality of seven conventional thermal electric elements 71, such as model number 9445 manufactured by International Thermal Electric, Incorporated of Chelmsford, Mass., are spaced apart longitudinally along each of first and second outer surfaces 56 and 57 for providing heating or cooling to core element 52 (see FIGS. 4–6). Each of the generally planar thermal electric elements 71 is provided with a first or inner heat transfer surface 72 which conforms generally to the shape of the planar outer surface 56 or 57 and an opposite second or outer heat transfer surface 73 which is heated when inner surface 72 is being cooled by element 71 and cooled when inner surface 72 is being heated by the element.

Clamping means or assembly 76 is included within thermal electric module 51 for clamping the seven thermal electric elements 71 to first outer surface 56 and the additional seven thermal electric elements 71 to second outer surface 57 as illustrated in FIGS. 5 and 6. Clamping assembly 76 includes a heat transfer member 77 for sandwiching each of the thermal electric elements 71 against the respective outer surface of core element 52. Heat transfer members 77 are each made from any suitable material such as OHFC copper and are each formed with a first or generally planar portion **77*a* which engages the thermal electric element 71 and a second or upstanding portion 77*b* formed integral with planar portion 77*a* and extending outwardly from the planar portion away from core element 52**.

Clamping assembly 76 further includes a first clamping plate 81 which serves to mount seven heat transfer members 77 and underlying thermal electric elements 71 on first outer surface 56 and a second clamping plate 82 which serves to mount seven heat transfer members 77 and associated underlying thermal electric elements 71 on second outer surface 57 (see FIGS. 5 and 6). Each of the elongate clamping plates 81 and 82 is formed from a clamping body 83 made from aluminum or any other suitable material and provided with a first or inner planar surface 86 and an opposite second or outer planar surface 87 parallel to inner surface 86. A plurality of seven square-shaped openings 91 sized to snugly receive an upstanding portion **77*b* of a clamping member 77 are longitudinally spaced-apart along each of bodies 83 at approximately equal distances. The portions of the bodies 86 forming the periphery of openings 91 overlap planar portions 77*a* of the heat transfer members 77. Inner surface 86 of each body 83 is provided with a groove 92 extending around and opening into each opening 91** formed therein.

O-rings 93 made from any suitable sealable and elastomeric material such as rubber serve as flexible means for permitting the heat transfer members 77 to move independently relative to each other and clamping plates 81 and 82. An O-ring 93 circumscribes upstanding portion **77*b* of each heat transfer member 77 and seats within the respective groove 92 when the clamping plate is mounted about the heat transfer members 77 and core element 52. O-rings 93 and grooves 92 are sized so that clamping body 83 does not engage heat transfer members 77 directly and, instead, the mounting forces of body 83** are transmitted through the O-rings to the heat transfer members.

Thermal electric module 51 further includes spaced-apart first and second planar side plates 96 made from any suitable material such as aluminum which extend between clamping plates 81 and 82 spaced apart from each side of core element 52. First and second clamping plates 81 and 82 and side plates 96 are secured together by any suitable means such as screws 97 extending through respective bores 98 between inner and outer surfaces 86 and 87 of the respective clamping body 83 and received within respective threaded bores 101 provided in the side plates 96. In this manner, side plates 96 are included within the means of thermal electric module 51 for mounting clamping plates 81 and 82 to core element 52.

Each of clamping plates 81 and 82 is provided with a channel 106 which opens onto outer surface 87 of clamping body 83 and extends longitudinally along the center of the clamping plate (see FIG. 6). Openings 91 extend into the bottom of channel 106. Spaced-apart first and second planar elongate cover plates 107 made from aluminum or any other suitable material extend across outer surface 87 of each of clamping plates 81 and 82 and, together with the clamping plates, form first and second clamping members of thermal electric module 51. Cover plates 107 are secured to the clamping plates by any suitable means such as screws 108 which pass through the cover plate and are received within threaded bores 111 extending through the outer surfaces 87 of the clamping plates. The clamping plates 81 and 82 are each formed with an elongate groove 116 formed in outer surface 87 around channel 106 for receiving a sealing strand 117 made from any suitable material such as rubber.

First clamping plate 81 and its associated cover plate 107 serve to form a longitudinally-extending first lumen or passageway 118 in core element 52 and second clamping plate 82 and its associated cover plate 107 serve to form a longitudinally-extending second lumen or passageway 119 in the core element. First passageway 118 includes a lower bore opening 118*a* extending longitudinally through the lower end of clamping plate 81 and an upper bore opening 118*b* extending longitudinally through the upper end of clamping plate 81. Second passageway 119 similarly includes a lower bore opening 119*a* extending longitudinally through the lower end of clamping plate 82 and an upper bore opening 119*b* extending longitudinally through the upper end of clamping plate 82. Each of the passageways 118 and 199 communicates with the opening 91 in the respective clamping body 83. O-rings 93 additionally serve as fluid tight seals between the clamping plates and heat transfer members 77 which extend through openings 91. Upstanding portions 77*b* of each heat transfer member 77 includes spaced-apart generally parallel fins 121 which extend longitudinally into passageway 118.

First and second internal lumens 61 and 62 connect with each other at bottom end 54 and at top end 53 of core element 52 as illustrated in FIG. 4. Bottom end piece 52*d* of the core element is provided with an internal chamber 122 which communicates with lumens 61 and 62. A longitudinal bore 123 extends from chamber 122 to the bottom end of end piece 52*d* and a side bore 124 extends from bore 123 to one side of the end piece 52*d*. Top end piece 52*c* of the core element is provided with an internal chamber 126 into which each of lumens 61 and 62 open. A longitudinal bore 127 extends upwardly from chamber 126 to the top end of the end piece 52*c*.

Thermal electric module 51 includes a lower elbow shaped fitting 128 which extends through the side plate 96 and has a flange 128*a* secured to bottom end piece 52*d* by any suitable means such as screws 129 so as to communicate with side bore 124. An O-ring 131 is carried by flange 128*a* and circumscribes the external opening of bore 124 to provide a fluid tight seal between flange 128 and core element 52. Outlet fitting 43 is provided with a flange portion 43*a* which is secured to the top of end piece 52*c* so that the outlet fitting 43 is in fluid communication with upper longitudinal bore 127. An O-ring 132 is carried by top end piece 52*c* around the opening of bore 127 and engages flange portion 43*a* for providing a fluid tight seal therebetween. A conventional pressure relief valve 136 is provided and has a flange portion 136*a* attached to the bottom of end piece 52*d* about the external opening of longitudinal bore 123. An O-ring 137 is carried by lower end piece 52*d* around bore 123 and engages flange portion 136*a* of valve 136 to provide a fluid tight seal between valve 136 and end piece 52*d*.

Temperature control module 16 includes a second liquid carrying means in the form of secondary circulatory system 138 for circulating any suitable liquid such as city water through thermal electric module 51 (see FIGS. 3 and 5–9). Circulatory system 138 includes first and second passageways 118 and 119 and serves to remove heating or cooling from heat transfer members 77 in communication with passageways 118 and 199. Passageways 118 and 119 are interconnected at the upper end of thermal electric module 51 by means of upper fluid transfer plate member or plate 139, conventional flow sensor 141, first and second tubular couplings 142 and 143 and tubular depending member 144.

Figure 8:
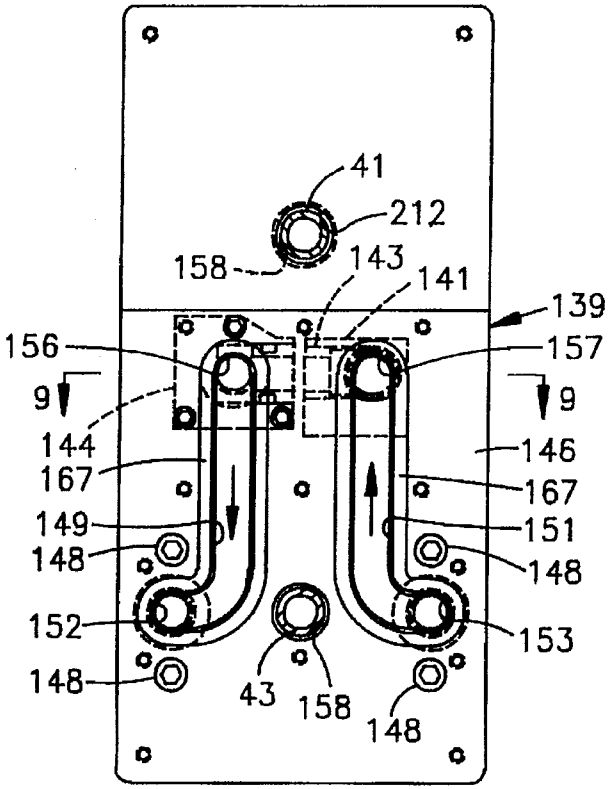
FIG. 8 is a cross-sectional view of the compact replaceable temperature control module of FIG. 2 taken along the line 8—8 of FIG. 7.
Figure 7:
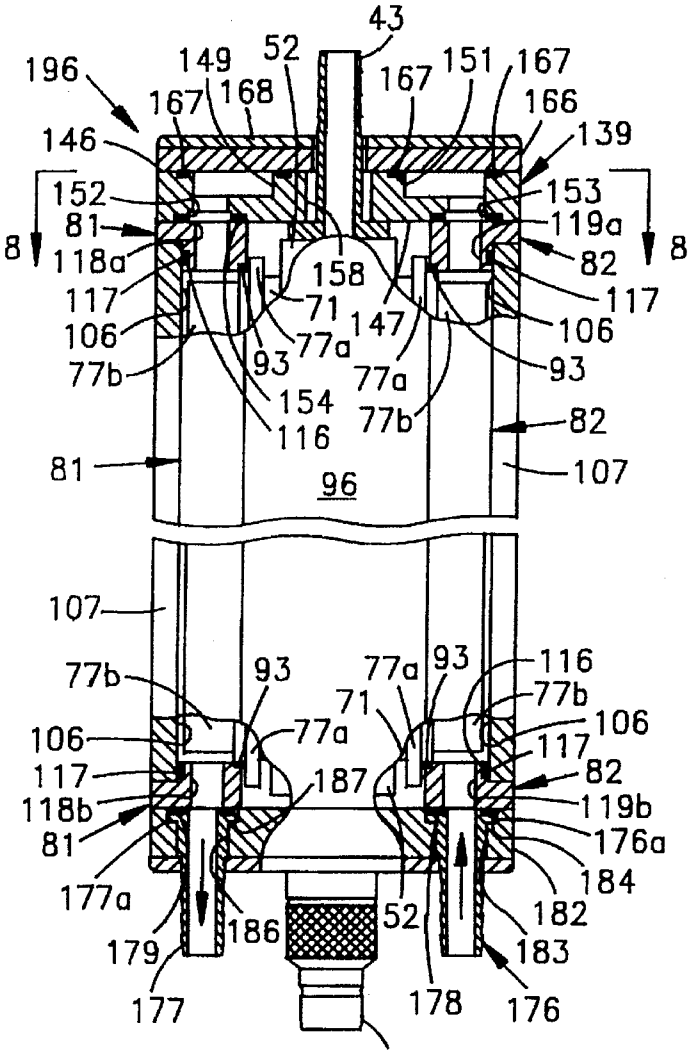
FIG. 7 is a partial cross-sectional view of the compact replaceable temperature control module of FIG. 2 taken along the line 7—7 of FIG. 4.
Figure 9:
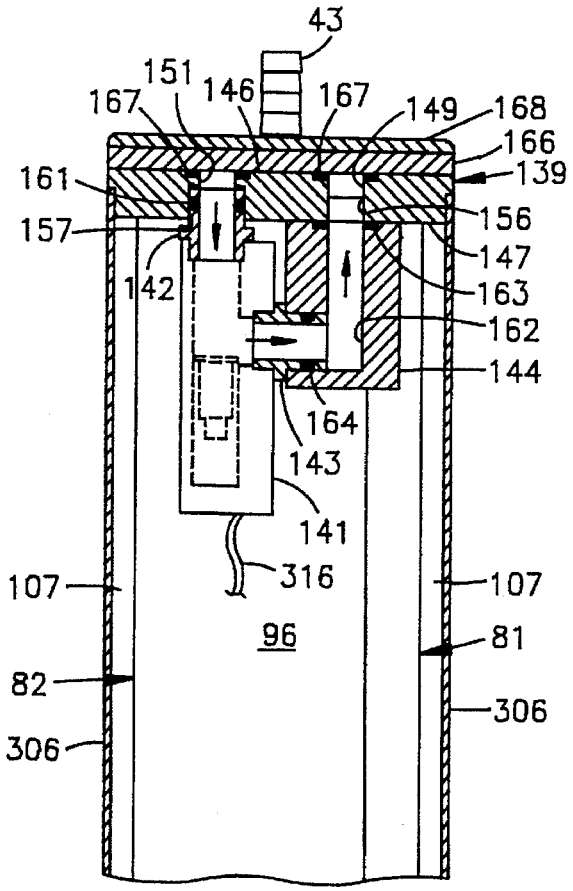
FIG. 9 is a cross-sectional view of the compact replaceable temperature control module of FIG. 2 taken along the line 9—9 of FIG. 8.

Fluid transfer plate 139 is formed with a first or upper planar surface 146 and an opposite second or lower planar surface 147 and is secured to the upper end of first and second clamping plates 81 and 82 by bolts 148 or any other suitable means (see FIGS. 7–9). Bolts 148 extend through respective bores (not shown) in plate 139 and are threadedly secured within respective bores (not shown) in the clamping plates 81 and 82. First and second spaced-apart channels 149 and 151 are provided in upper surface 146. A bore 152 in communication with upper bore opening 118*b* of first clamping plate 81 extends through lower surface 147 into the bottom of one end of first channel 149. Another bore 153, which is in communication with upper bore opening 119*b* of second clamping plate 82, extends through lower surface 147 into the bottom of one end of second channel 151. A circular groove is formed in the lower surface 147 around each of bores 152 and 153 for receiving O-rings 154 which provide a fluid-tight seal between fluid transfer plate 139 and first and second clamping plates 81 and 82. Fluid transfer plate 139 is further provided with bores 156 and 157 which extend respectively through lower surface 147 into the other ends of first and second channels 149 and 151 and a further bore 158 which extends through surfaces 146 and 147 between bores 152 and 153 for receiving outlet fitting 43.

First coupling 142 has an upper end portion press fit or otherwise securely disposed within bore 157, as shown in FIG. 9, and a bottom end portion similarly secured within the inlet opening of flow sensor 141. An annular groove is provided in the upper end portion of first coupling 142 for receiving O-ring 161. Tubular depending member 144 is secured to lower surface 147 by bolts 162 or any other suitable means. Bolts 162 are disposed within bores (not shown) extending through surfaces 146 and 147 of fluid transfer plate 139 and are threadedly disposed within bores (not shown) extending through the top of depending member 144. A fluid passageway 162 extends through depending member 144 and communicates at its upper end with bore 156 of plate 139. Member 144 is provided with a circular groove around the upper opening of passageway 162 for receiving O-ring 163. Second coupling 143 has a first end portion press fit or otherwise suitably disposed within the outlet opening of flow sensor 141 and a second end portion similarly disposed within the bottom opening of fluid passageway 162. O-ring 164 is concentrically carried about the second end portion of coupling 143 for providing a fluid-tight seal between the coupling and depending member 144.

A sealing plate 166 is secured to upper surface 146 of fluid transfer plate 139 (see FIGS. 7 and 9). First and second grooves are provided in upper surface 146 around each of first and second channels 149 and 151 for receiving O-ring-like sealing elements or strands 167 which provide a fluid-tight seal between plates 166 and 139 around each of channels 149 and 151. A top end cover plate 168 extends over sealing plate 166 and is secured thereto by any suitable means such as screws (not shown). Each of plates 166 and 168 are provided with bores for receiving outlet fitting 43 which extends therethrough.

An inlet tubular barbed fitting 176 and an outlet tubular barbed fitting 177 are provided at the lower end of thermal electric module 51 as illustrated in FIG. 7. Inlet fitting 176 is formed with an upper flange portion or flange 176*a* which is disposed against the lower end of second clamping plate 82 so that the internal passageway of fitting 176 is in communication with lower bore opening 119*a* of clamping plate 82. Flange 176*a* is provided with a circular groove therearound for receiving O-ring 178 which provides a fluid-tight seal between fitting 176 and clamping plate 82. Outlet fitting 177 similarly has an upper flange 177*a* provided with a circular groove for receiving an O-ring 179. Flange 177*a* is disposed against the bottom end of first clamping plate 81 so that the passageway of fitting 177 is in fluid communication with lower bore opening 118*a* of clamping plate 81.

A lower plate member or plate 182 serves to secure fittings 176 and 177 to clamping plates 82 and 81. In this regard, plate 182 is provided with a first bore 183 for receiving fitting 176. Bore 183 opens into an enlarged annular recess 184 provided in the upper surface of plate 182 for cooperatively receiving flange 176*a*. Plate 182 is further provided with a second bore 186 for receiving outlet fitting 177 and a second annular recess 187 sized and shaped to cooperatively receive flange 177*a* of fitting 177. Lower plate 182 is secured to clamping plates 81 and 82 by any suitable means such as bolts (not shown). A lower end plate 188 is secured to the bottom of plate 182 by any suitable means such as screws (not shown). Lower plate 182 and lower end plate 188 are provided with respective bores 191 and 192 for receiving release valve 136.

Cover plates 107 and side plates 96 serve to form a portion of housing 196 for thermal electric module 51 (see FIGS. 2–4). Housing 156 further includes sealing plate 167 and overlying top end plate 168 and lower plate 182 and underlying bottom end plate 188.

Figure 10:
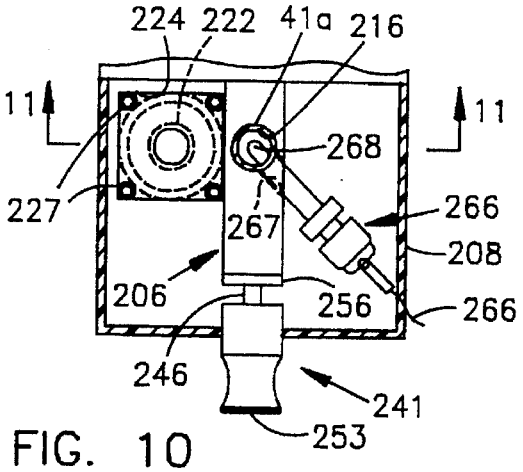
FIG. 10 is a cross-sectional view of the compact replaceable temperature control module of FIG. 2 taken along the line 10—10 of FIG. 4.
Figure 11:
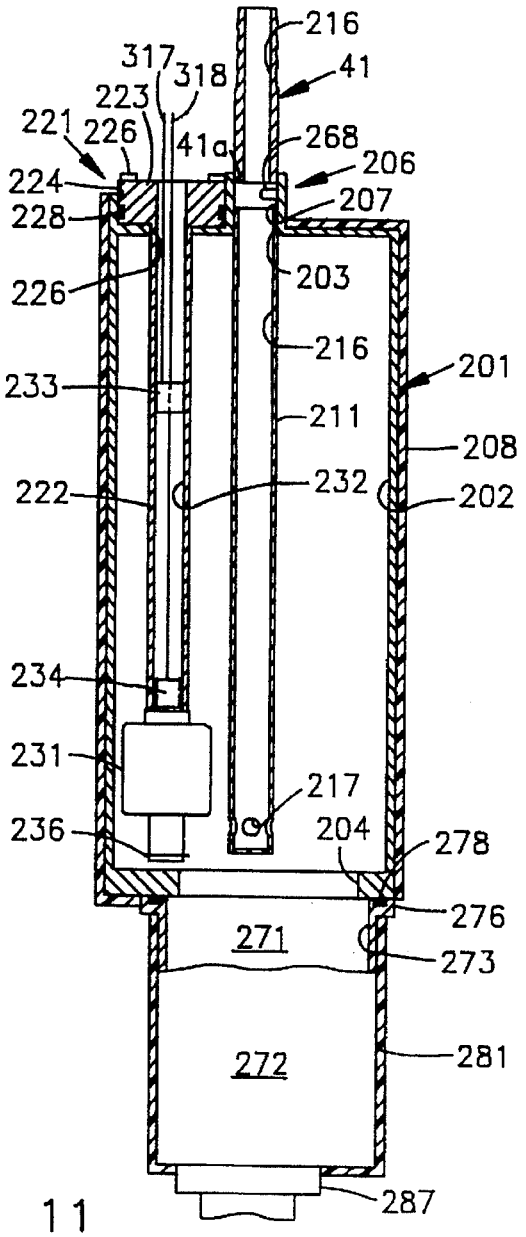
FIG. 11 is a cross-sectional view of the compact replaceable temperature control module of FIG. 2 taken along the line 11—11 of FIG. 10.

First or primary circulatory system 38 further includes a reservoir tank 201 carried within housing 36 as illustrated in FIGS. 4, 10 and 11. Tank 201 is made from any suitable material such as stainless steel and is provided with an internal chamber 202 having a top opening 203 and a bottom opening 204. An integral housing 206 is formed on the top of tank 201. A vertical bore 207 extends upwardly from top opening 203 through housing 206. A suitable insulation 208 made from silicone rubber or any other suitable material generally encases tank 201.

A vertically disposed inlet tube 211 made from any suitable material such as stainless steel extends from top opening 203 to the bottom of internal chamber 202. The top end portion of inlet tube 221 extends upwardly through opening 203 and is press fit or otherwise suitably secured within vertical bore 207 in housing 206. Inlet barb fitting 41 extends downwardly through a bore 212 in top end cover plate 168 and a bore 218 in sealing plate 166 and has a lower extremity 41*a* which is press fit or otherwise suitably secured within bore 207 of housing 206. A continuous inlet passageway 216 is provided which extends downwardly through inlet fitting 41 and inlet tube 211. Inlet tube 211 has a closed lower end and is provided with a plurality of circumferentially spaced-apart ports 217 at the bottom thereof which extend from inlet passageway 216 into the bottom of internal chamber 202 of reservoir tank 201.

Means in the form of float assembly 221 is included within temperature control module 16 for sensing at least two levels of the dielectric liquid in reservoir tank 201 (see FIGS. 10–11). Float assembly 221 includes a depending tubular element or tube 222 extending downwardly below an enlarged mounting block 223. Mounting block 223 is disposed within a cooperatively formed recess 224 formed on the top of reservoir tank 201 and tube 222 extends through a bore 226 in the top of the reservoir tank into internal chamber 202. Mounting block 223 is secured within recess 224 by any suitable means such as bolts 227. An O-ring 228 is disposed in a groove formed around the circumference of mounting block 223 for providing a fluid-tight seal between the mounting block and tank 201 when the mounting block is disposed within recess 224.

A conventional float switch such as manufactured by Gems Sensors is carried by tube 222 and includes a float 231 slidably mounted on the outside of tube 222. A central bore extends through mounting block 223 and tube 222 along the length of float assembly 221. A first or upper magnet 233 and a second or lower magnet 234 are disposed within bore 232 and, as can be appreciated by those skilled in the art, cooperate with float 231 to indicate whether the level of liquid within reservoir tank 201 is near magnet 233 or magnet 234. A C-clip 236 is mounted on the bottom of tube 222 for limiting the downward travel of float 231 thereon.

Figure 12:
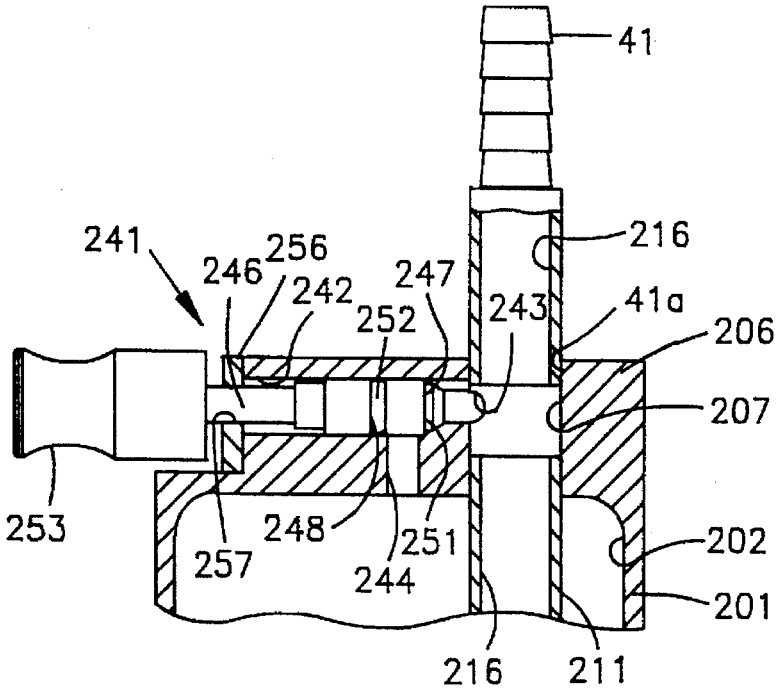
FIG. 12 is an enlarged fragmentary view, partially cross-sectioned, of a portion of the compact replaceable temperature control module of FIG. 4 in a first position.
Figure 13:
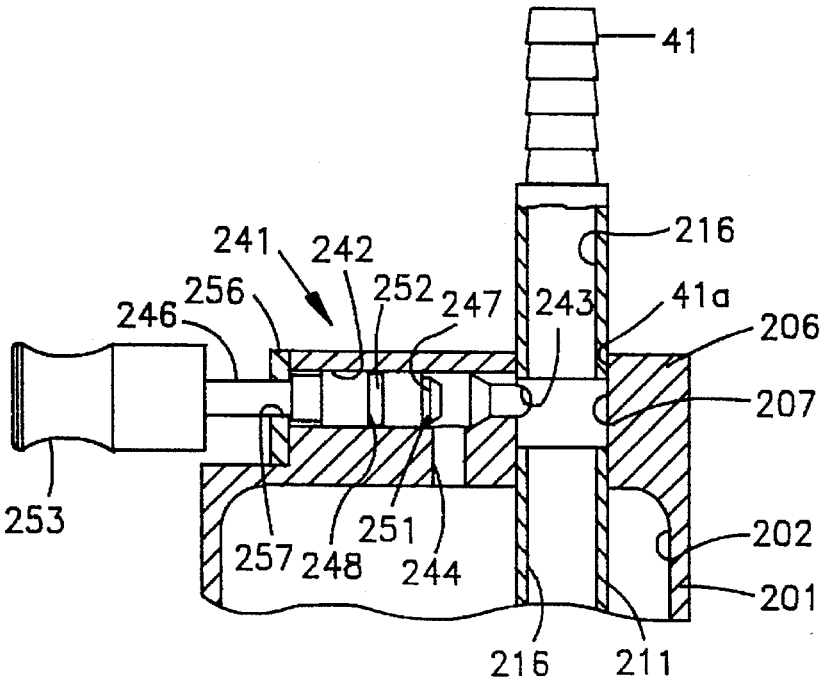
FIG. 13 is an enlarged fragmentary view similar to FIG. 12 of a portion of the compact replaceable temperature control module of FIG. 4 in a second position.

A manually actuable bleed valve 241 is carried by housing 206 for providing communication between inlet passageway 216 and the top of internal chamber 202 within reservoir tank 201 (see FIGS. 4 and 12–13). Bleed valve 241 includes a bore 242 which extends horizontally through housing 206 to an opening 243 into inlet passageway 216 as illustrated in FIGS. 12 and 13. A vertically disposed bore 244 extends downwardly from horizontal bore 243 through housing 206 and the top of reservoir tank 201 into internal chamber 202. Bleed valve 241 further includes a valve stem 246 slidably carried within horizontal bore 242 and provided with spaced-apart first and second annular grooves 247 and 248 for carrying respective first and second O-rings 251 and 252. Each of these O-rings provides a fluid-tight seal between the valve stem 246 and the internal surface of housing 206 forming horizontal bore 242. Valve stem 246 extends outwardly from horizontal bore 242 and has a knob 253 formed on the end thereof. A valve cap 256 provided with a central bore 257 through which valve stem 246 extends is secured about the opening of horizontal bore 242 by any suitable means such as bolts (not shown).

Valve stem 246 is movable between a first or closed position, shown in FIG. 12, and a second or open position, shown in FIG. 13. When the valve stem 246 is in its closed or contracted position, second O-ring 252 is disposed between opening 213 and vertical bore 244 so as to restrict the flow of liquid through opening 213 and bore 244 between inlet passageway 241 and internal chamber 202. First O-ring 251 restricts any liquid from flowing further in horizontal bore 242 and past valve cap 256. When the valve stem 246 is in its open or extended position, the distal end of the valve stem and second O-ring 252 carried thereby have moved toward valve cap 256 past vertical bore 244 so that liquids are free to move between inlet passageway 216 and the top of internal chamber 202 through opening 213, horizontal bore 242 and vertical bore 244.

Sensing means in the form of temperature sensor 266 is carried by external housing 36 and, in particular, housing 206 for sensing the temperature of liquid flowing through inlet passageway 216 (see FIG. 10). Sensor 266 can be of any suitable types such as a 100 ohm platinum resistive thermal device. Housing 206 is provided with a second horizontally-extending bore 267 extending into vertical bore 207 and sensor 266 is threadedly mounted within bore 267. The sensor 266 has a tip 268 which extends through an opening in inlet tube 271 into internal passageway 216.

Temperature control module 16 further includes means in the form of filter 271 carried by housing 36 for removing air from the liquid traveling through primary circulatory system 38 (see FIGS. 4 and 11). Filter 271 can be made from any suitable porous material which permits liquid to flow therethrough but which promotes the coalescence of any air carried within the liquid. In one preferred embodiment of the invention, filter 271 is in the form of a sponge. A filter housing 272 made from any suitable material such as stainless steel is carried by reservoir 201. Filter housing 272 is formed with an internal chamber 273 which extends through the open upper end of the filter housing. A flange 276 is formed around the upper end of filter housing 272 and, together with bolts 277 extending through the flange and threadedly received within respective bores in the bottom of reservoir tank 201, is included within the means for securing the filter housing 272 to reservoir tank 201. An O-ring 278 is disposed in a groove provided in the upper surface of flange 276 and sealably engages the bottom of reservoir tank 201. The filter housing 272 has a generally square cross-sectional shape when viewed in a plane parallel to flange 276 and is generally encased in an insulation 281 similar to insulation 208.

Temperature control module 16 has means in the form of pump 286 for causing the dielectric liquid carried within primary circulatory system 38 to flow through passageways 61 and 62 of hollow core element 52 so as to cause the temperature of the dielectric liquid to more closely approximate the temperature of the core element. Pump 286 is preferably an electromagnetically coupled pump and can be of any suitable type such as pump Model No. EG101-0024/F manufactured by Micropump Corporation of Vancouver, Wash. which is a 30 volt DC pump which operates at about seven psi. As illustrated in FIGS. 4 and 11, pump 286 has an inlet 287 which is secured by any suitable means such as bolts 288 to the bottom of filter housing 272. An opening 291 is formed in filter housing 272 at the bottom thereof so that filter internal chamber 273 communicates with pump inlet 287. Pump 286 includes a fan housing 292 which extends downwardly through bottom plate 182 and bottom end plate 188 so as to be exposed to the outside of housing 36. Housing 292 is formed with an outer flange 293 which rests on plate 182 and thus supports pump 286, filter housing 272, reservoir tank 201 and inlet tube 211 within housing 36. Pump outlet 296 includes a barbed pump outlet fitting 297 which communicates with lower fitting 128 of thermal electric module 51 via flexible hose 298 which is press fit or otherwise suitably secured to pump fitting 297 at one end and to module fitting 128 at the other end. Circulatory system 38 of temperature control module 16, tubes 42 and 44 and the process module 18 for which the temperature is being monitored by the temperature control module 16 form a closed loop system 299.

Temperature control module housing 36 includes a jacket 306 formed from a U-shaped panel made from aluminum or any other suitable material. Jacket 306 extends around reservoir tank 201, filter housing 272 and pump 286. Screws 307 serve to secure jacket 306 to the interiorly-disposed side plate 96 and top and bottom plates 139 and 182 (see FIG. 4). In addition to jacket 306, it can be seen that module housing 36 is further formed from cover plates 107, the exteriorly-disposed side plate 96 and top and bottom end plates 168 and 188.

Means is included within temperature control module 16 for permitting control signals and power to be applied thereto and includes a first or communications connector 308 and a second or power connector 309. Electrical leads 316, 317 and 318 serve to respectively connect flow sensor 141 and upper and lower magnets 233 and 234 of float assembly 221 to communications connector 308, while leads 321 and 322 serve to respectively connect temperature sensor 266 and pump 286 to the communications connector 308. For simplicity, only a portion of these leads have been shown in the drawings. Power connector 309 is connected to the pump 286 and to the thermal electric elements 71 wired in series within thermal electric module 51 by electrical leads (not shown).

A conventional controller and power supply are used with temperature control module 16 in the temperature control system of the present invention for adjusting the temperature of core element 52 in response to the temperature of the dielectric liquid sensed by the temperature sensor 266. Controller 312, which includes a bi-directional switching power supply with an adjustable power level, is shown generally in FIG. 1 and is electrically connected to communications connector 308 by first cable 313 and to power connector 309 by second cable 314. Among other things, controller 312 receives electrical signals from temperature sensor 266 and uses this information to control the supply of power and thus the operation of thermal electric module 51.

In operation and use, point-of-use temperature control module 16 can be used for heating or cooling a dielectric or other suitable liquid so as to regulate the internal temperature of a chamber in a semiconductor manufacturing system, such as an etching apparatus 22 or other process module 18 in a cluster tool 21.

The compact size of temperature control module 16 and the thermal electric module 51 therein permits the module 16 to be located relatively close to the process module 18 in which the temperature is being controlled by module 16. In FIG. 1, a temperature control module 16 is mounted to each of first and second etchers 27 and cooler 32 of cluster tool 21. It should be appreciated, however, that the temperature control modules 16 can be otherwise situated in close proximity to the process modules 18 of tool 21 and be within the scope of the present invention. For example, the temperature control modules 16 could be placed beneath the process modules 18 or carried by other portions of cluster tool 21. Thus, compact temperature control module 22 can be carried within the footprint of the process module 18 and cluster tool 21 within clean room 22.

Compact temperature control module 16 permits a dielectric liquid to be used in the heating or cooling of etcher 27 and the other process modules 18. A dielectric liquid is a desirable heat transfer liquid because it has a relatively high resistivity and thus exhibits relatively low current leakage while travelling through the serpentine passages of the process module. As can be appreciated by those skilled in the art, current leakage through the liquid is undesirable in plasma vapor etching machines because it might effect the RF powered operation of the lower electrode or electrostatic chuck in the process module and thus undesirably effect the gases therein and the semiconductor manufacturing process. A dielectric liquid is also desirable because it does not freeze at relatively low temperatures.

Primary circulatory system 38 of temperature control module 16 requires only approximately 1500 milliliters of dielectric liquid during operation. When charging temperature control module 16 with the dielectric liquid, discharge and inlet tubes 42 and 44 are first connected to the related process module 18 and pressure relief valve 136 closed. The dielectric liquid is placed in a separate canister (not shown) which is pressurized and then connected to relief valve 136. Bleed valve 196 is opened by moving valve stem 246 to its open position illustrated in FIG. 13. The canister containing the pressurized dielectric liquid is opened to permit the liquid to flow through pressure relief valve 136 into circulatory system 38. The dielectric liquid travels upwardly through first and second internal passages 61 and 62 of thermal electric module 51 and through lower fitting 128 of core element 52 to pump 286 and up through filter housing 272 into internal chamber 202 of reservoir tank 201. The dielectric liquid flows through ports 191 at the bottom of inlet tube 178 up through inlet passageway 176. The open bleed valve 196 permits the air in reservoir tank 201 to escape through vertical bore 201 and horizontal bore 242 into the inlet passageway 216. The 1500 milliliters of dielectric liquid fills temperature control module 16 and thus forces most, if not all, of the air in primary circulatory system 38 into tubes 42 and 44 and process module 18. Upon completion of this filling procedure, bleed valve 196 and pressure relief valve 136 are closed and the canister disconnected from the bleed valve 136.

Temperature control module 16 is placed in operational condition by actuating pump 286 which causes the dielectric liquid to circulate through closed loop system 253 at approximately two gallons per minute. During the start-up procedure, sponge filter 271 serves to impede the flow of air through system 253 and cause the air to coalesce and rise through ports 191 to the top of reservoir tank internal chamber 202. When reservoir tank 201 is so filled with dielectric liquid, float switch 192 moves on tube 222 to a position adjacent upper magnet 233 so as to signal controller 312 that temperature control module 16 has been properly charged with dielectric liquid.

Once the air in closed loop system 253 has been discharged to reservoir tank 201, temperature sensor 266 can be utilized to monitor the temperature of the dielectric liquid within the closed loop system 253 and indicate to controller 312 whether the operating temperature is above or below the desired set temperature. The illustrated embodiment of the temperature control system of the present invention can be utilized for maintaining a set temperature in the range of 10° to 70° C. during a manufacture process.

During the operation of temperature control module 16, controller 312 operates thermal electric module 51 to heat or cool the dielectric liquid received by inlet fitting 41 of the temperature control module so that the temperature of the liquid being received generally approximates the set temperature. As can be appreciated by those skilled in the art of thermal electronics, the direction and amount of electrical current supplied to thermal electric elements 71 can be adjusted so that the inner heat transfer surfaces 72 thereof serve as either heat sources or heat sinks. When, for example, it is desired that the dielectric liquid be heated by the thermal electric module 51, controller 312 provides power to thermal electric elements 71 to cause inner heat transfer surfaces 72 to heat core element 52 and thus heat the dielectric liquid travelling through internal passageways 61 and 62 of the core element. Fins 63 and 64 increase the aggregate internal surface of the passageways and thus enhance the heat transfer efficiency between thermal electric module 51 and the dielectric liquid passing therethrough. Conversely, when cooling of the dielectric liquid is needed, the power to thermal electric elements 71 is reversed so as to cause inner heat transfer surfaces 72 to cool core element 52.

If the level of dielectric liquid within reservoir tank 201 falls to the height of lower magnet 234 during operation, float assembly 221 sends a signal to controller 312 which in turn shuts down temperature control module 16 or takes other appropriate action.

A suitable secondary liquid such a city water is pumped through second circulatory system 138 to remove cooling when thermal electric module 51 is in a heating mode and to remove heat when the module 51 is in a cooling mode. The water enters thermal electric module 51 through inlet fitting 176 and travels up one side of the module 51 through passageway 119 before passing through channel 151 of fluid transfer plate 139 on its way to flow sensor 141. The water then returns through channel 149 of plate 139 and back down the other side of the module 51 via passageway 118 before being discharged through outlet fitting 177. Heat transfer members 77 transfer the cooling or heat from outer heat transfer surfaces 73 of thermal electric elements 71 to the water within secondary circulatory system 138. In particular, the cooling or heat is picked up by planar portion **77*a* of each heat transfer member 77 and transferred to the secondary liquid by the spaced-apart fins 121 formed on upstanding portion of 77*b* of the heat transfer member 77. Controller 312 is able to confirm that secondary circulatory system 138 is operational through the signal received from flow sensor 141. Controller is programmed to shut down temperature control module 16 and cluster tool 21 if the desired flow of water through circulatory system 138** ceases.

The novel clamping assembly 76 of the present invention facilitates generally full engagement of inner heat transfer surface 72 of each thermal electric element 71 with outer surface 56 or 57 of core element 52 during operation of thermal electric module 51. As can be appreciated by those skilled in the art, core element 52 tends to expand or contract and thus bend or twist slightly during operation due to the heat or cooling being applied to the core element by thermal electric elements 71 and the dielectric liquid passing through module 51. This movement of the core element can cause undesirable hot spots on the thermal electric elements in contact therewith.

Clamping assembly 76 permits each of heat transfer members 77 and thus the thermal electric elements 71 mounted to core element 52 by the heat transfer members to move independent relative to each other and thus accommodate these changes in the shape of core element 52. In particular, O-rings 93 permit the heat transfer members 77 to rotate slightly about the various perpendicular axes which lie within the plane of planar portion **77*a* in response to forces placed on the underlying thermal electric elements 71 by core element 52. The generally nonrigid connection between clamping plates 81 and 82 and heat transfer members 77 permits thermal electric elements 71 to adjust in the x, y and z directions to the shape changes of the core element and thus maintain generally full engagement between inner heat transfer surfaces 72 of the thermal electric elements and outer surfaces 56 and 57 of the core element and between outer heat transfer surfaces 73 of the thermal electric elements and planar portions 77*a* of the heat transfer members. In this manner, surface contact and heat transfer between core element 52 and thermal electric elements 71 is optimized and a high operating efficiency maintained despite thermal expansion or contraction of core element 52**.

Temperature control module 16 permits the internal surface of the process module 18, such as upper surface 34 of the chuck in etcher 27, to be brought to the desired temperature relatively quickly. As discussed above, the relatively compact size of temperature control module 16 permits its placement close to the process module 18. This close proximity reduces the distances which the dielectric liquid must travel between control module 16 and the process module 18 and thus reduces the amount of dielectric liquid required in closed loop heating or cooling system 253. Since temperature control module 16 requires approximately only 1500 milliliters of dielectric liquid, the temperature of this small volume of liquid and thus the temperature of surface 34 regulated thereby can be adjusted quickly.

The relative close proximity of temperature control module 16 to the associated process module 18 also serves to reduce the power requirements of the temperature control module 16. In the illustrated embodiment, pump 286 requires only 100 watts of power. Thermal electric module 51 requires only 1.6 kilowatts of power under maximum operation. It is preferred that each of modules 16, as illustrated, be located not more than approximately four feet from the related process module 18 so as to operate pump 286 and the other components in control module 16 within their design tolerances.

A further advantage of temperature control module 16 is that it permits more accurate measurement of the temperature of the regulated internal surface 34 in the process module 18. As discussed above, temperature sensor 266 measures the temperature of the dielectric liquid immediately after the liquid enters the temperature control module 16. Accordingly, changes in the temperature of surface 34 and corresponding changes in the temperature of the dielectric liquid regulating surface 34 can be quickly and accurately picked up by temperature sensor 266. These temperature readings are more accurate than what would be obtained if one merely monitored the temperature of the dielectric liquid within reservoir tank 201 because the temperature of the liquid within tank 201 is not necessarily equal to the temperature of the liquid entering the tank at any given time.

Temperature control module 16 and controller 312 together form a dynamic system which is capable of maintaining the temperature of internal surface 34 at a relatively constant number. The relative close proximity of temperature control module 16 to process module 18, the relatively small amount of dielectric liquid used in control module 16, the accurate measurement by control module 16 of the temperature of surface 34 in module 18 and the inclusion in controller 312 of a binary switching power supply which can be on, off or somewhere in between permit such a dynamic system. Unlike conventional static systems, in which the rate of change in the temperature of the surface 34 or object being controlled is greater than the system can respond, the dynamic system of the present invention is able to respond quickly to the loads being placed on chuck surface 34 and thus maintain a constant temperature on surface 34. This ability to maintain a relatively constant surface temperature is advantageous in semiconductor manufacturing where repeatability and predictability of an operation are very desirable.

The relative ease and speed at which the temperature of internal surface 34 can be changed facilitates cleaning of etcher 27. As can be appreciated by those skilled in the art, regular and frequent cleanings of a process module enhance the efficiency and life of the process module. In such a cleaning procedure, the internal chamber of the process module may be elevated to a temperature of approximately 70° C. The temperature control system of the present invention permits an operator to heat the dielectric liquid and thus the internal chamber of the process module relatively quickly in comparison to currently available heating and cooling systems. Since preventive maintenance cycles tend to occur at the expense of duty cycles, it is highly desirable to minimize the duration of these maintenance cycles.

Should maintenance be required on the process module 18 regulated by a temperature control module 16, the dielectric liquid can be easily drained from the process module by simply pulling on knob 211 to cause bleed valve 196 to move to its open position. As discussed above, the dielectric liquid is now free to travel from the upper portion of inlet passageway 216 through bores 242 and 201 into reservoir tank 201. In this manner, the dielectric liquid within the process module 18 can drain under the force of gravity into the reservoir tank to permit disassembly or maintenance of the process module.

Although the temperature control module or apparatus of the present invention has been illustrated and described as regulating the temperature of only one process module of a cluster tool utilized in a semiconductor manufacturing process, it should be appreciated that a temperature control apparatus which regulates two or more process modules would be within the scope of the present invention. It should also be appreciated that the temperature control module hereinabove described can be used in a broad range of semiconductor manufacturing apparatus, such as tungsten or other etching apparatus and chemical vapor deposition, vacuum sputtering or other material deposition apparatus.

In view of the foregoing, it can be seen that a new and improved compact heat exchanger for use with a wafer processing chamber in a semiconductor manufacturing apparatus has been provided. The heat exchanger has a small size so that it can be located in close proximity to the chamber. It can be used with a process module of a cluster tool and, more specifically, can be located within the footprint of the process module. The heat exchanger utilizes a plurality of thermal electric elements mounted in spaced apart positions on a core element. The thermal electric elements are movable relative to each other so as to enhance full engagement between the thermal electric elements and the core element during expansion and contraction of the core element.

What is claimed is:

1. A compact heat exchanger for adjusting the temperature of a stream of liquid of unknown temperature comprising a hollow core element provided with a passageway which extends therethrough and has first and second end portions, the core element having an outer surface extending thereallong adjacent the passageway, an inlet fitting coupled to the core element in communication with the first end portion of the passageway for receiving the stream of liquid and an outlet fitting coupled to the core element in communication with the second end portion of the passageway for discharging the stream of liquid, a plurality of thermal electric elements spaced apart along the outer surface of the core element for providing heating or cooling to the core element, each thermal electric element having a heat transfer surface which generally conforms to the outer surface of the core element, and means for clamping the plurality of thermal electric elements to the outer surface of the core element which includes a heat transfer member for each thermal electric element and permits the heat transfer members to move independent of each other whereby the relative independent movement of the heat transfer members facilitates full engagement of the heat transfer surfaces of the thermal electric elements with the outer surface of the core element during expansion and contraction of the core element.

2. A compact heat exchanger as in claim 1 wherein the outer surface and the thermal electric elements are each generally planar and wherein the heat transfer members each have a generally planar portion for engaging the thermal electric elements and pressing them against the outer surface of the core element.

3. A compact heat exchanger as in claim 2 wherein each heat transfer member includes an upstanding portion extending outwardly from the generally planar portion away from the core element and wherein the means for clamping includes an elongate clamping member provided with a plurality of openings spaced apart longitudinally therealong for receiving the upstanding portions of the heat transfer members and means for mounting the clamping member to the core element, elastomeric means disposed between the heat transfer members and the clamping member for permitting relative movement between each heat transfer member and the clamping member when the clamping member is mounted on the core element.

4. A compact heat exchanger as in claim 3 wherein the elastomeric means includes an O-ring disposed circumferentially around each upstanding portion.

5. A compact heat exchanger as in claim 3 wherein the clamping member is provided with a passageway extending longitudinally therethrough in communication with the openings for carrying a secondary liquid which transfers heat or cold away from the thermal electric elements.

6. A compact heat exchanger as in claim 5 wherein the upstanding portion of each heat transfer member includes a plurality of spaced-apart longitudinally-extending fins through which the secondary liquid flows.

7. A compact heat exchanger as in claim 1 wherein the core element has an additional outer surface extending therealong adjacent the passageway and opposite the first named outer surface, a plurality of additional thermal electric elements spaced apart along the additional outer surface, each additional thermal electric element having a heat transfer surface which generally conforms to the additional outer surface, and means for clamping the plurality of additional thermal electric elements to the additional outer surface of the core element which is similar to the first named means for clamping.

8. A compact heat exchanger for adjusting the temperature of a stream of liquid of unknown temperature comprising an elongate core element having first and second end portions and provided with a passageway extending longitudinally between the first and second end portions, the elongate core element having a planar outer surface extending longitudinally between the first and second end portions adjacent the passageway, an inlet fitting coupled to the first end portion in communication with the passageway for receiving the stream of liquid and an outlet fitting coupled to the second end portion in communication with the passageway for discharging the stream of liquid, the elongate core element being provided with a plurality of longitudinally-extending spaced-apart fins extending into the passageway for engaging the stream of liquid, a plurality of planar thermal electric elements spaced apart longitudinally along the outer surface for providing heating or cooling to the core element, and means for clamping the plurality of thermal electric elements to the outer surface of the core element which includes a heat transfer member for each thermal electric element, each heat transfer member having a planar surface for engaging the thermal electric element, the means for clamping further including elastomeric means for urging the heat transfer members against the thermal electric elements and permitting the heat transfer members to move independent of each other whereby the relative independent movement of the heat transfer members facilitates full engagement of the heat transfer surfaces of the thermal electric elements with the outer surface of the core element during expansion and contraction of the core element.

9. A compact heat exchanger as in claim 8 wherein the core element has an additional planar outer surface extending longitudinally therealong, the passageway extending longitudinally between the outer surface and the additional outer surface, a plurality of additional planar thermal electric elements spaced apart longitudinally along the additional outer surface and means for clamping the plurality of additional thermal electric elements to the additional outer surface of the core element which is similar to the first named means for clamping.

* * * * *